US009903072B2

(12) United States Patent
Yildirim et al.

(10) Patent No.: US 9,903,072 B2
(45) Date of Patent: Feb. 27, 2018

(54) COMPOSITIONS COMPRISING KAOLIN TREATED WITH A STYRENE-BASED POLYMER AND RELATED METHODS

(71) Applicant: Imerys Pigments, Inc., Roswell, GA (US)

(72) Inventors: Ismail Yildirim, Warner Robins, GA (US); Robert J. Pruett, Milledgeville, GA (US); Paul M. Meizanis, Gray, GA (US)

(73) Assignee: Imerys USA, Inc., Roswell, GA (US)

( * ) Notice: Subject to any disclaimer, the term of this patent is extended or adjusted under 35 U.S.C. 154(b) by 58 days.

(21) Appl. No.: 14/656,563

(22) Filed: Mar. 12, 2015

(65) Prior Publication Data

US 2015/0259857 A1 Sep. 17, 2015

Related U.S. Application Data

(63) Continuation of application No. 14/344,349, filed as application No. PCT/US2012/054777 on Sep. 12, 2012, now abandoned.

(60) Provisional application No. 61/535,241, filed on Sep. 15, 2011.

(51) Int. Cl.

| | |
|---|---|
| ***D21H 21/16*** | (2006.01) |
| ***D21H 19/42*** | (2006.01) |
| ***D21H 19/58*** | (2006.01) |
| ***D21H 17/64*** | (2006.01) |
| ***D21H 19/38*** | (2006.01) |
| ***D21H 19/40*** | (2006.01) |
| ***D21H 17/67*** | (2006.01) |
| ***D21H 17/69*** | (2006.01) |

(52) U.S. Cl.

CPC ..... *D21H 21/16* (2013.01); *D21H 17/64* (2013.01); *D21H 17/67* (2013.01); *D21H 17/69* (2013.01); *D21H 19/38* (2013.01); *D21H 19/40* (2013.01); *D21H 19/42* (2013.01); *D21H 19/58* (2013.01)

(58) Field of Classification Search

USPC ..... 162/158, 164.1, 168.1, 168.7, 162/181.1–181.2, 181.8, 183–185; 106/400, 401, 461, 463–465, 471, 499

See application file for complete search history.

(56) References Cited

U.S. PATENT DOCUMENTS

| | | | | |
|---|---|---|---|---|
| 2,576,914 | A * | 12/1951 | Barrett | D21H 19/46 427/361 |
| 3,028,258 | A * | 4/1962 | Rice | D21H 25/14 427/362 |
| 5,747,141 | A | 5/1998 | Claytor | |
| 5,885,340 | A * | 3/1999 | Bailey | D21H 19/44 106/209.1 |
| 6,001,490 | A | 12/1999 | Rienäcker et al. | |
| 7,208,039 | B2 | 4/2007 | Jones et al. | |
| 7,214,264 | B2 | 5/2007 | Jones et al. | |
| 7,214,728 | B2 * | 5/2007 | Kimpimaki | D21H 19/36 524/17 |
| 7,226,005 | B2 | 6/2007 | Jones et al. | |
| 2004/0023004 | A1 | 2/2004 | Kimpimaki et al. | |
| 2004/0221976 | A1 | 11/2004 | Williams et al. | |
| 2006/0032405 | A2 | 2/2006 | Jones et al. | |
| 2006/0124033 | A1 | 6/2006 | Pruett et al. | |
| 2006/0249051 | A1 | 11/2006 | Pruett et al. | |
| 2008/0319115 | A1 | 12/2008 | Munchow | |
| 2010/0151255 | A1 | 6/2010 | Williams et al. | |
| 2010/0310883 | A1 | 12/2010 | Brungardt | |
| 2011/0230601 | A1 * | 9/2011 | Nieberle | C09C 1/021 524/48 |

FOREIGN PATENT DOCUMENTS

| | | | |
|---|---|---|---|
| CN | 1692770 | A | 3/2005 |
| EP | 0 870 872 | A1 | 10/1998 |
| EP | 1 396 576 | A1 | 3/2004 |
| EP | 1 416 088 | B1 | 2/2010 |
| EP | 1 416 087 | B1 | 9/2010 |
| EP | 2 314 766 | A1 | 4/2011 |
| WO | WO 01/04416 | A1 | 1/2001 |
| WO | WO 01/59215 | A1 | 8/2001 |
| WO | WO 01/86067 | A1 | 11/2001 |
| WO | WO 03/022933 | A2 | 3/2003 |
| WO | WO 03/078734 | A1 | 9/2003 |
| WO | WO 2009/114071 | A1 | 9/2009 |
| WO | WO 2013/039986 | A1 | 3/2013 |

OTHER PUBLICATIONS

Karato et al, "Electrical conductivity of minerals and rocks", No Date, 92 pages, [online], retrieved from the Internet, retrieved Jan. 28, 2017, <URL:http://people.earth.yale.edu/sites/default/files/files/Karato/36PCDE-II%20%28Karato%29.pdf>.*

Office Action dated May 7, 2015, in related Chinese Patent Application No. 201280056276.0.

(Continued)

*Primary Examiner* — Dennis Cordray

(74) *Attorney, Agent, or Firm* — Finnegan, Henderson, Farabow, Garrett & Dunner LLP

(57) ABSTRACT

A mineral composition and related methods may include a mineral treated with a styrene-based polymer. The mineral treated with a styrene-based polymer may be used for a coating on a paper product having a first Cobb value that is less than a second Cobb value of the paper product with the coating devoid of the mineral composition.

25 Claims, 1 Drawing Sheet

(56) References Cited

OTHER PUBLICATIONS

Cray Valley Resins par excellence—Application Bulletin—"Dispersions of Titanium Dioxide with SMA® Resins", 3 pages.
Cray Valley Resins par excellence—Application Bulletin—"SMA® Resins for High Gloss and Thermal Resistant Overprint Varnishes", 3 pages.
International Search Report and Written Opinion dated Jan. 9, 2013, in PCT International Application No. PCT/US2012/054777, filed Sep. 12, 2012.
Extended European Search Report issued in related European Application No. 12832442.3, dated Jan. 7, 2015.

* cited by examiner

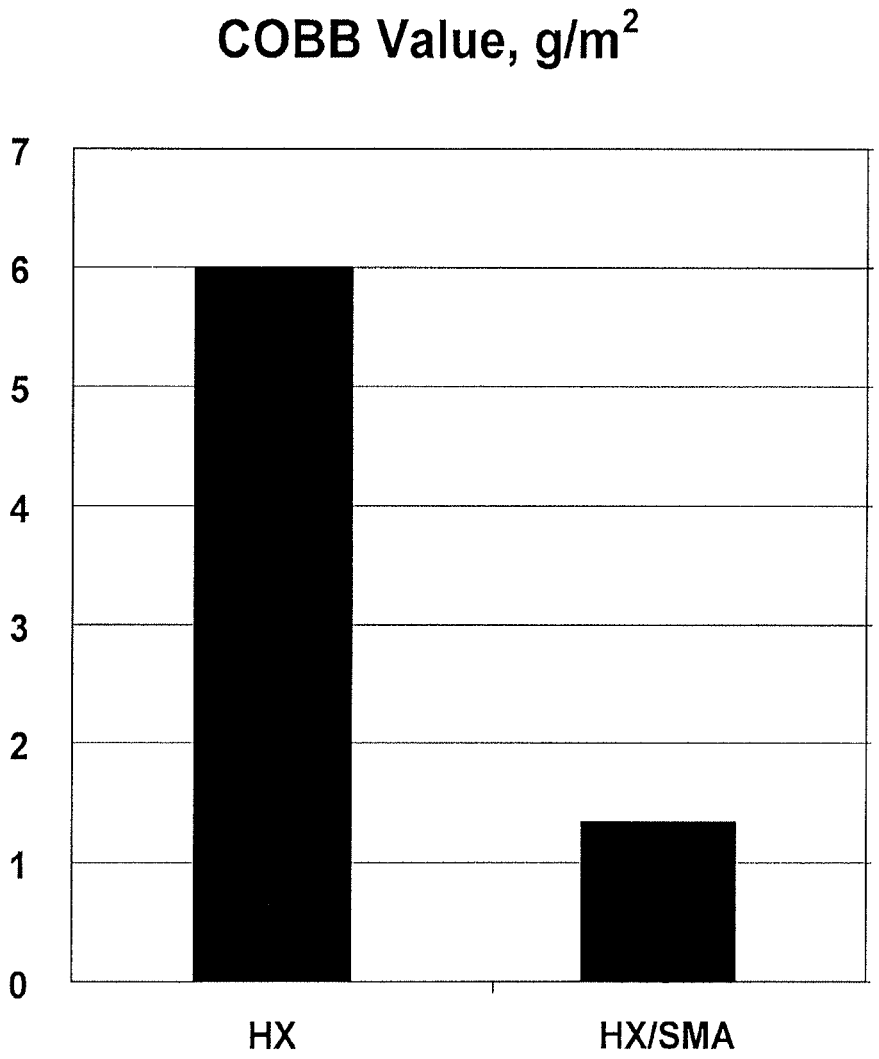
COBB Value, g/m2
7
6
5
4
3
2
1
0
HX
HX/SMA

COMPOSITIONS COMPRISING KAOLIN TREATED WITH A STYRENE-BASED POLYMER AND RELATED METHODS

CLAIM OF PRIORITY

This is a continuation of U.S. Ser. No. 14/344,349, filed Mar. 12, 2014, which is a U.S. national stage entry under 35 U.S.C. § 371 from PCT International Application No. PCT/US2012/054777, filed Sep. 12, 2012, which claims priority to and the benefit of the filing date of U.S. Provisional Application No. 61/535,241, filed Sep. 15, 2011, to all of which this application claims the benefit of priority, and the entirety of the subject matter of all of which is incorporated herein by reference.

FIELD OF THE DISCLOSURE

The present disclosure relates to compositions comprising minerals suitable for use in coatings for paper products. In particular, the present disclosure relates to compositions comprising minerals treated with a styrene-based polymer for coating paper products, such as paperboard for packaging having water barrier properties, and methods related to minerals treated with a styrene-based polymer.

BACKGROUND OF THE DISCLOSURE

Minerals may be used in pigments in paper coating and filling compositions. For example, kaolinite, the principal constituent of kaolin clay (or kaolinitic clay), is a white clay mineral that imparts brightness, gloss, smoothness, printability, and/or other desirable properties to the surface of coated paper, paperboard, super-calendared paper, and other paper-related products. Minerals may also be used, for instance, in barrier coatings on paper to impart to paper resistance to moisture, moisture vapor, grease, oil, and air, for example. Such coatings are described in, for example, U.S. Pat. Nos. 7,208,039, 7,214,264, and 7,226,005, which are all hereby incorporated by reference in their entirety.

Typical wax coatings on corrugating paper products offer water barrier properties that may surpass other protective coatings used for corrugated containers. However, wax is derived from petroleum distillation by-products, which are becoming less available and more costly. In addition, the inability to easily recycle these one-time-use wax products may be undesirable.

Re-usable plastic containers might be used in place of corrugated paper products for non-durable food packaging. However, recyclable corrugated containers offer economic advantages as compared to re-usable plastic containers due to their ability to be recycled. For example, the used old corrugated containers may be sold for recycling for favorable prices.

In some instances, latex coating used as a wax coating replacement satisfies the sustainability requirements of retailers for recyclable packaging. Latex coatings can impede liquid water absorption and water vapor transmission. However, the application of latex onto paper products requires additional production costs such as off-line or on-line coating, followed by elevated-temperature-drying by air impingement, irradiation, or other drying processes, or a combination thereof. In addition, the cost of latex is substantially greater than wax and thus a disadvantage.

Accordingly, it would be desirable to provide compositions for coating paper-related products that result in improved barrier performance. For example, it would be desirable to provide coating compositions for coating paper, paperboard, or corrugated linerboard, to provide structural integrity and strength under a number of conditions, for instance, under wet or refrigerated conditions.

SUMMARY OF THE DISCLOSURE

In the following description, certain aspects and embodiments will become evident. It should be understood that the aspects and embodiments, in their broadest sense, could be practiced without having one or more features of these aspects and embodiments. It should be understood that these aspects and embodiments are merely exemplary.

According to one aspect, a mineral composition for use in a coating on a paper product may include a mineral treated with a styrene-based polymer. The paper product may have a first Cobb value less than a second Cobb value of the paper product with the coating being devoid of the mineral composition.

According to a second aspect, a method for making a mineral slurry may include dispersing a mineral treated with a styrene-based polymer in an aqueous composition.

According to another aspect, a method for making a coating for a paper product may include providing a mineral slurry in the coating, wherein the paper product has a first Cobb value less than a second Cobb value of the paper product with the coating devoid of the mineral.

The minerals may include, for example, calcium carbonate (synthetic, precipitated, or ground from naturally occurring material), calcined kaolin, hydrous kaolin, talc, mica, dolomite, silica, zeolite, gypsum, satin white, titania, calcium sulphate, and/or plastic pigment.

Possible advantages of the disclosed embodiments will be set forth in part in the description which follows, or may be learned by practice of the embodiments.

It is to be understood that both the foregoing general description and the following detailed description are exemplary and explanatory only and are not restrictive of the invention, as claimed.

BRIEF DESCRIPTION OF THE DRAWING

FIG. 1 is a bar graph showing the Cobb values of paper coated with untreated kaolin and kaolin treated with styrene maleic anhydride in accordance with an exemplary embodiment of the present invention.

DESCRIPTION OF EXEMPLARY EMBODIMENTS

Reference will now be made in detail to exemplary embodiments of the invention.

According to some embodiments, a mineral composition for use in a coating on a paper product may include a mineral treated with a styrene-based polymer. For example, the mineral may include calcium carbonate (synthetic, precipitated, or ground from naturally occurring material), calcined kaolin, hydrous kaolin, talc, mica, dolomite, silica, zeolite, gypsum, satin white, titania, calcium sulphate, and/or plastic pigment. The paper product may have a first Cobb value less than a second Cobb value of the paper product with the coating being devoid of the mineral composition. For instance, in one embodiment the first Cobb value ranges from about 0 $g/m^2$ to about 100 $g/m^2$. In another embodiment, the first Cobb value ranges from about 1 $g/m^2$ to about 75 $g/m^2$. In another embodiment, the first Cobb value ranges from about 20 $g/m^2$ to about 60 $g/m^2$. In still another embodiment, the first Cobb value ranges from about 1 $g/m^2$ to about 25 $g/m^2$. In yet another embodiment, the first Cobb value ranges from about 1 $g/m^2$ to about 10 $g/m^2$. In one embodiment, the paper product having a coating including a mineral treated with a styrene-based polymer has a first Cobb value less than a second Cobb value of the paper product with the coating including untreated mineral.

"Cobb value" as used herein is defined as the water absorption (in weight of water per unit area) of a sample. The procedure for determining the "Cobb value" is: 1) weigh the sample; 2) place the sample in a holder with the appropriate ring; 3) fill the ring with water; 4) wait 30 minutes; 5) pour off water; and 6) weigh the sample. The Cobb value is calculated by subtracting the initial weight of the sample from the final weight of the sample and then dividing by the area of the sample covered by the water.

In certain embodiments, the styrene-based polymer comprises styrene maleic anhydride, styrene butadiene, styrene acrylic, or a combination thereof. Styrene-maleic anhydride may be prepared by the polymerization of styrene or a styrenic monomer and maleic anhydride or derivatives thereof. For example, styrene maleic anhydride may be a copolymer of styrene and maleic anhydride with the ratio of styrene to maleic anhydride varying from 1:1 to 2:1 and greater.

In some embodiments, the mineral (e.g., kaolin) is treated with styrene maleic anhydride in an amount ranging from about 5 to about 400 pounds of styrene maleic anhydride per dry ton of mineral. In other embodiments, the mineral is treated with a styrene-based polymer in an amount ranging from about 25 to about 100 pounds of styrene-based polymer per dry ton of mineral. In another embodiment, the mineral is treated with styrene-based polymer in an amount ranging from about 30 to about 50 pounds of styrene-based polymer per dry ton of mineral. As used herein, "treated" or "treating" may include contacting, coating, and/or dispersing the styrene-based polymer onto or with the mineral, or similar processes.

In some embodiments, the mineral (e.g., kaolin) comprises a filter cake, an evaporator product, or a makedown slurry. In certain embodiments, the mineral comprises a mineral filter cake having a solids content ranging from about 45% to about 60% by weight. In particular embodiments, the mineral filter cake has a conductivity less than about 12,000 μS. In other embodiments, the mineral filter cake has a conductivity less than about 600 μS. In another embodiment, the mineral filter cake has a conductivity less than about 200 μS. For instance, the mineral may be a mineral filter cake having a particular conductivity prior to the time it is treated with a styrene-based polymer.

According to one aspect, the shape factor of the mineral (e.g., kaolin) treated with a styrene-based polymer may be at least about 10, at least about 20, at least about 30, at least about 40, at least about 50, at least about 60, at least about 70, or at least about 80. In particular embodiments, a high shape factor mineral (e.g., at least about 45) treated with a styrene-based polymer such as styrene maleic anhydride provides a surprising improvement in the water barrier properties of a coating containing such a mineral composition.

"Shape factor," as used herein, is a measure of the ratio of particle diameter to particle thickness for a population of particles of varying size and shape as measured using the electrical conductivity methods, apparatuses, and equations described in U.S. Pat. No. 5,576,617, which is incorporated herein by reference. As the technique for determining shape factor is further described in the '617 patent, the electrical conductivity of a composition of an aqueous suspension of orientated particles under test is measured as the composition flows through a vessel. Measurements of the electrical conductivity are taken along one direction of the vessel and along another direction of the vessel transverse to the first direction. Using the difference between the two conductivity measurements, the shape factor of the particulate material under test is determined.

In certain embodiments, the mineral composition (e.g., a kaolin composition) further comprises an aqueous solution substantially devoid of, or devoid of, sodium. In some embodiments, the mineral composition further comprises a pH adjuster. In one embodiment, the pH adjuster comprises ammonium hydroxide. In other embodiments, the pH adjuster may comprise potassium and/or ammonium hydroxides or carbonates, or combinations thereof. Without being bound by a particular theory, it is believed that pH adjusters such as ammonium flash-off or vaporize during processing (e.g., spray drying) before addition to a coating composition, and thus, do not affect the water barrier properties of the resultant coating.

In some embodiments, the pH of the mineral composition is adjusted to a pH ranging from about 6.0 to about 9.0, or a pH ranging from about 6.5 to about 8.5.

In particular embodiments, the mineral composition (e.g., a kaolin composition) further comprises a dispersant selected from the group consisting of a phosphate, a silicate, and a (poly)acrylate, wherein the dispersant is devoid of sodium. In some embodiments, the mineral composition further comprises carboxymethyl cellulose, used as a thickener, for instance.

In certain embodiments, the mineral composition (e.g., a kaolin composition) further comprises a mineral selected from the group consisting of mica, talc, gypsum, diatomaceous earth, calcium carbonate, attapulgite, bentonite, montmorillonite, and other natural clays (e.g., anhydrous or calcined kaolin clays) or synthetic clays. For example, the mineral composition may include mica in an amount ranging from greater than about 0 to about 5 wt %.

In certain embodiments, the coating including the mineral (e.g., kaolin) treated with a styrene-based polymer is printable.

In another aspect, the invention comprises a method for making a mineral slurry (e.g., a kaolin slurry) comprising dispersing a mineral treated with a styrene-based polymer in an aqueous composition. It has been surprisingly determined that adding styrene-based polymer to the mineral filter cake and/or to the beneficiated mineral slurry (e.g., makedown slurry) for later transport or spray drying before making a coating including the mineral treated with a styrene-based polymer, results in an improved coating barrier performance. In some embodiments, the mineral treated with a styrene-based polymer is dispersed using a makedown process, wherein a mixer is used to disperse the mineral and styrene-based polymer in an aqueous solution.

In some embodiments, the method further comprises adding a pH adjuster to the aqueous composition. For example, the pH adjuster may comprise potassium and/or ammonium hydroxides or carbonates, or combinations thereof.

In certain embodiments, the aqueous solution is substantially devoid of sodium. Without being bound by a particular theory, it is believed that the substantial absence, or absence of, sodium in the mineral slurry (e.g., a kaolin slurry) provides improved water barrier properties in resultant coating compositions including the mineral treated with a styrene-based polymer. In particular, improved water performance is achieved due to the lack of sodium (such as from typical dispersants), which is hydrophobic and absorbs water, and the use of a styrene-based polymer to disperse a mineral and, in combination with the mineral (e.g., kaolin), provide water barrier properties. In other words, though typical sodium-containing dispersants are not used, the mineral slurry imparting water barrier properties in a coating may still be dispersed at a high solids level due to the styrene-based polymer treatment. In certain embodiments, the mineral slurry has a solids content ranging from about 40% to about 60% by weight, or from about 47% to about 53% by weight. In some embodiments, the dispersing step can be carried out at a temperature ranging from about 75° F. to about 150° F.

According to another aspect, the mineral slurry may be in the form of a transportable kaolin slurry or a kaolin slurry to be spray-dried. The method may further include transporting the mineral slurry or the spray-dried mineral. In some embodiments, the mineral slurry may include water in an amount of at least about 20% by weight of the mineral slurry.

As used herein, "transportable mineral slurry" refers a mineral slurry, which includes fully beneficiated mineral, which is substantially resistant to settling or segregation for a period sufficient for transport from a first location to a second remote location. The pour test can by used as an indicator of the long-term stability of, for example, kaolin slurries. In the pour test, a number of samples of the slurry are placed into beakers and weighed. At selected time intervals, one of the beakers is upended, and the sample is allowed to pour out for a period of one minute. The beaker is then re-weighed, and the percentage of sample that is successfully poured from the beaker is determined as a percentage of the total initial sample weight. Generally, the higher the pour-test percentage, the more stable the slurry is against settling. The stability test may include monitoring the viscosity of the slurry over a 28-day period using a T-bar spindle. After twenty-eight days, the weight percent of the slurry that poured out of the jar in one minute is measured and is designated as the first pour. The sample is returned to the jar and shaken for a few seconds and again poured out for one minute to obtain the weight percent of the slurry for the second pour. For instance, a transportable kaolin slurry may have a 28-day pour test result of at least about 85% poured. The final slurry sample obtained after the 28-day stability tests (before the first pour-off) and obtained from the second pour-off can also be analyzed for the low-shear Brookfield viscosity at 20 to 100 rpm using an appropriate spindle (typically #1 or #2 spindle) and high-shear viscosity using a Hercules viscometer. Brookfield and Hercules viscosity measurements on the aged slurries could be used as an indicator/predictor of slurry rheology properties during transportation and storage.

According to a further aspect, a substrate, such as a paper product, may be coated with a coating composition including a mineral (e.g., kaolin) treated with a styrene-based polymer. For example, the base substrate may include, paper, paperboard, or corrugated linerboard.

According to yet a further aspect, a coating composition may include a mineral (e.g., kaolin) treated with a styrene-based polymer and binder. For example, the binder may include at least one of wheat, corn, potato, and tapioca. According to a further aspect, the binder may include at least one of acrylic latex, vinyl acetate latex, casein, polyvinyl alcohol, and polyvinyl acetate.

According to a further aspect, the binder may comprise from about 3% to about 30% by weight of the coating composition. For example, the binder may comprise from about 3% to about 50% by weight of the coating composition. According to further aspects, the binder may comprise from about 10% to about 40% by weight of the coating composition. By including a mineral (e.g., kaolin) treated with a styrene-based polymer in a coating composition, it may be possible to reduce the amount of binder needed to achieve the same coating properties as a coating devoid of such a mineral composition. In certain embodiments, the coating composition may include about 20% to about 70% solids by weight, wherein 70% by weight of the solids is mineral treated with a styrene-based polymer.

According to some embodiments, mineral compositions (e.g., kaolin compositions) may have one or more of the following characteristics:

A. Particle size distribution: $d_{50}$ ranging from about 0.2 micron to about 1.5 microns, $d_{90}$ ranging from about 1 micron to about 10 microns, about 10% to about 99% less than 2 microns, and about 20% to about 80% less than 0.25 micron;

B. GE Brightness: at least about 89.0, advantageously at least about 90.0, and at least about 92.0;

C. Brookfield viscosity, measured at 20 rpm and at less than or equal to about 65% solids: about 50 to about 700 centipoise, and in certain embodiments, about 200 to about 500 centipoise; and D. Hercules viscosity, measured at 18 dynes and at less than or equal to about 65% solids: about 200 rpm to about 3500 rpm, and in certain embodiments, about 500 rpm to about 2000 rpm, and about 700 rpm to about 1000 rpm.

The mineral compositions (e.g., kaolin compositions) according to some embodiments may also optionally exhibit a steepness ($d_{30}/d_{70}\times100$) of at least about 30, the value of which changes with embodiments to at least about 35, at least about 40, at least about 45, and at least about 50.

"GE Brightness," as expressed herein, is defined in TAPPI Standard T452 and refers to the percentage reflectance to light of a 457 nm wavelength according to methods well known to those of ordinary skill in the art.

"Viscosity," as used herein, is a measure of the rheological properties of a mineral (e.g., a kaolin clay). In particular, viscosity is a measure of resistance of the mineral to changes in flow. Those having ordinary skill in the art are familiar with typical ways of measuring viscosity, which include Brookfield viscosity and Hercules viscosity.

Brookfield viscometers provide a measure of a low shear viscosity of a mineral slurry, expressed in units of centipoise. One centipoise is equal to one centimeter-gram-second unit. (One centipoise is one one-hundredth ($1\times10^{-2}$) of a poise.) Thus, all other things being equal, a 100 centipoise sample has a lower viscosity than a 500 centipoise sample.

Hercules viscometers provide a measure of a high shear viscosity of a mineral slurry (e.g., a kaolin slurry). Hercules viscosity is typically measured by placing a cylinder (bob) of appropriate diameter and length (typically the A-bob) into a sample mineral slurry. Hercules viscosities of various samples can be compared by holding constant the percent solids concentration of the sample, the bob size, and the applied force. The Hercules viscometer applies a force to the bob, which causes it to spin at a controlled acceleration rate. As the viscometer increases the bob spin rate, the viscous drag on the cup increases. Mineral slurries (e.g., clay slurries) with poor high shear rheology will exert the maximum measurable force on the cup at a lower bob rpm than mineral slurries with "good" high shear rheology. Hercules viscosity is therefore typically expressed in terms of bob spin rates, or revolutions per minute (rpm). A "dyne endpoint" is an indication of very low Hercules viscosity. A dyne endpoint is reached when the bob reaches its maximum rpm before the maximum measurable force is exerted on the cup.

"Particle size," as used herein, for example, in the context of particle size distribution (psd), is measured in terms of equivalent spherical diameter (esd). Sometimes referred to as the "$d_{50}$" value, median particle size and other particle size properties referred to in the present application may be measured in a well known manner, for example, by sedimentation of the particle material in a fully-dispersed condition in an aqueous medium using a SEDIGRAPH 5100 machine, as supplied by Micromeritics Corporation. Such a machine may provide measurements and a plot of the cumulative percentage by weight of particles having a size, referred to in the art as "equivalent spherical diameter" (esd), less than the given esd values. The mean particle size $d_{50}$ is the value that may be determined in this way of the particle esd at which there are 50% by weight of the particles that have an esd less than that $d_{50}$ value.

"Steepness: ($d_{30}/d_{70}\times100$)," as used herein, refers to the steepness (or narrowness) of the particle size distribution (psd). This, in turn, refers to the slope of the psd curve of the particulate kaolin according to the present disclosure. "Steepness," as used herein, may be measured as 100 times the ratio of the $d_{30}$ to $d_{70}$, where "$d_{30}$" is the value of the particle esd less than which there are 30% of the particles, and "$d_{70}$" is the value of the particle esd less than which there are 70% of the particles, both of which may be obtained from the Sedigraph measurement described above.

According to exemplary embodiments disclosed herein, coating compositions may comprise a particulate mineral (e.g., a particulate kaolin clay) that is processed material derived from a natural source, such as, for example, raw natural kaolin clay mineral. For example, a processed kaolin clay may typically contain at least about 50% by weight kaolinite. For example, most commercially-important processed kaolin clays contain greater than about 75% by weight kaolinite and may contain greater than about 90%, in some cases greater than about 95% by weight, of kaolinite. The kaolin compositions according to the exemplary disclosed embodiments may be prepared according to the exemplary process described below.

For example, a crude feed kaolin clay may first be blunged. Any suitable kaolin feed capable of providing a product having the desired properties may serve as the crude feed. Any suitable kaolin crude feed may serve as the feed, however.

According to some embodiments, blunging mixes the crude feed clay (or other mineral) with water in a high-energy mixer, known by those skilled in the art as a "blunger." A sufficient amount of water may be added during blunging to form an aqueous suspension of the crude. Typically, the blunged suspension will contain from about 60% to about 70% solids. However, the blunging may be carried out at solids as low as about 20% according to some embodiments.

Initially and during blunging, the pH of the slurry will typically be in the range of from about 4.0 to about 9.5, or from about 6.5 to about 8.0. The pH of the suspension may be adjusted during blunging, typically to within about 0.5 pH units of neutral to help deflocculate the suspension. The pH may be adjusted by the addition of any known or after-discovered chemicals, gases, or other agents capable of bringing the pH to suitable levels. For example, pH adjusting chemicals include, but are not limited to, sodium, potassium, and/or ammonium hydroxides or carbonates, for example, sodium hydroxide or sodium carbonate. Appropriate amounts of the pH adjusting agent may be added as desired to achieve the target pH, typically in the range of from about 0.5 to about 5.0 pounds per tbn.

According to some embodiments, dispersing agents may also be added during blunging to aid in forming the aqueous suspension. Suitable dispersing agents include any known or after-discovered dispersing agents capable of aiding deflocculation. For example, dispersing agents may include ammonium or potassium salts of hexametaphosphate, polyphosphate, silicates, polyacrylate, and/or polyacrlamide/acylate copolymers. Dispersing agents are typically added in a dose range of about 2 to about 10 lbs. per ton of kaolin on a dry basis. According to some embodiments, the dose range may be from about 3 to about 6 lbs. per ton.

After blunging, the crude suspension may be fractionated as desired into fine and coarse fractions. Fractionation (or classification) may be performed using any known or after-discovered method. Exemplary methods include gravity sedimentation or elutriation, use of any type of hydrocyclone apparatus or a solid bowl decanter centrifuge, disc nozzle centrifuge, or the like.

The separated coarse fraction, sometimes referred to as the "b-fraction," typically has a psd, such that the percentage of particles having an esd less than 2 μm is from about 20% to about 40%. The b-fraction may be diluted such that the esd less than 2 μm ranges from about 10% to about 60%, with certain embodiments ranging from about 30% to about 50%, with about 40% solids being exemplary. The b-fraction may also be mixed with one or more of the aforementioned dispersing agents.

The b-fraction may thereafter be subjected to delamination. Delamination may be accomplished by any known or after-discovered methods, such as, for example, sand or attrition grinding, bead milling, and/or ball milling. Delamination may be achieved in any proprietary grinder or commercially available apparatus including, but not limited to, a Denver attrition scrubber, a Drias mill, a Netsch mill, a Matter mill, and vibo-energy mill.

The delaminated b-fraction and/or fine fraction may thereafter be subjected to one or more beneficiation processes to improve brightness and to remove impurities as desired. According to some embodiments, the delaminated b-fraction and/or fine fraction may be subjected to magnetic separation and/or reductive bleaching to remove iron- and/or titanium-containing impurities, as well as other impurities as desired. Appropriate magnetic separators include any commercial or proprietary "high intensity" magnetic separator with a minimum applied field strength of, for example, 0.5 tesla. Suitable equipment may include the Carpco reciprocating magnet or a PEM HIMS (High Intensity Magnetic Separator). Permanent magnet systems, copper coil electromagnet systems, and/or superconducting magnet systems can be employed.

Exemplary reductive bleaching agents include sodium hydrosulfite (hydros) in doses ranging from about 0.5 to about 5 pounds per ton of mineral (e.g., kaolin), for example, less than about 4 pounds per ton on a dry basis. Any other suitable reductive bleaching agents, such as, for example, formamidine sulphinic acid, may be employed. Reductive bleaching using hydros may be preferably carried out in acidic pH, such as, for example, a pH in the range of from about 2.0 to about 4.5. Any mineral, organic acid, and/or alum solution may be used to adjust the pH to the desired value. For example, pH modifiers include sulfuric acid, with a pH of from about 2.5 to about 3.5, and alum solution, with a pH of from about 3.5 to about 4.5. In both cases, sodium hydrosulfite may act as the reductive bleaching agent.

According to some embodiments, the mineral slurry may be mixed with a chosen acidifying agent(s) to bring the pH to the desired value, as dictated by kinetics and other considerations.

The fully beneficiated mineral (e.g., kaolin) may thereafter be advantageously filtered and redispersed to form an aqueous slurry as described herein.

The refined, neutral mineral may thereafter be subjected to evaporation and/or spray-drying as desired, and its solids level adjusted to an upper limit as dictated by the rheological characteristics desired for the intended mineral composition. In the case of the mineral compositions according to exemplary embodiments, the upper limit may be about 65% solids, but lower solids concentrations may be achieved according to the desired specification.

According to some embodiments, a coating composition may include a mineral composition, and the mineral composition may be treated with styrene-based polymer. According to some embodiments, a fully beneficiated mineral slurry may be treated with styrene-based polymer, for example, by adding styrene-based polymer to the fully beneficiated mineral filter cake.

According to some embodiments, styrene-based polymer may be added to mineral compositions without it being desirable to substantially or slightly modify mineral production parameters, production processes, and/or formulations for preparing coating compositions. Thus, treating the mineral composition with styrene-based polymer may be transparent to mineral processors and/or coating manufacturers.

According to some embodiments, a commercially available kaolin composition may be treated with styrene-based polymer, for example, by adding styrene-based polymer to a composition containing the commercially available kaolin composition.

Cellulose substrates coated with some embodiments of coating compositions disclosed herein may be used in printing processes. Normal paper, LWC paper, and/or ULWC paper, or any other suitable substrates, may optionally be used. Products and compositions disclosed herein may be used in the production of all paper grades, for example, from ULWC paper to coated or filled board (e.g., corrugated linerboard). Paper and paperboard products may comprise a coating, which may improve the brightness and/or opacity of the coated paper or coated board.

According to some embodiments, the paper coating compositions may include a mineral (e.g., calcined kaolin) and materials generally used in the production of paper coatings and paper fillers. For example, the coating compositions may include a binder and a pigment, such as, for example, $TiO_2$. According to some embodiments, the coating compositions may include, but are not limited to, other additives (e.g., polyvinyl alcohol), such as, for example, dispersants, cross-linkers, water retention aids, viscosity modifiers or thickeners, lubricity or calendaring aids, antifoamers/defoamers, gloss-ink hold-out additives, dry- or wet-rub improvement or abrasion-resistance additives, dry- or wet-pick improvement additives, optical brightening agents or fluorescent whitening agents, dyes, biocides, leveling or evening aids, grease- or oil-resistance additives, water-resistance additives, and/or insolubilizers.

EXAMPLE

In this Example, commercially-available BARRISURF HX® (available from IMERYS of Roswell, Ga.), a particulate kaolin clay, was used to form a coating composition for coating paper prior to water absorption testing to determine the Cobb value of the coated paper. The Table below lists the parameters used during a method of making a kaolin slurry, including kaolin treated with a styrene-based polymer in accordance with an embodiment of the present invention.

BARRISURF HX® is a commercially-available particulate kaolin clay that has a shape factor of approximately 90, a d50 of 1.535, and a steepness of 27. The typical particle size distribution is as follows: 62% by weight less than 2 μm; 37% by weight less than 1 μm; 26% by weight less than 0.5 μm; 11% by weight less than 0.25 μm. The GE Brightness is 86. The styrene maleic anhydride-treated kaolin sample (e.g., with the styrene maleic anhydride having a styrene-to-maleic anhydride ratio of about 1:1) was made from filter cake and mixed in the Cowles mixer at 2,000 rpms for 20 minutes. The sample was produced at high solids. The Brookfield viscosity (#2 spindle) was taken at ambient temperature.

TABLE

| Filter Cake Solids | Slurry Solids | Brookfield viscosity 20 rpms | Brookfield viscosity 100 rpms | Temperature ° F. | pH | SMA dose |
|---|---|---|---|---|---|---|
| 49.5 | 49.1 | 68 | 162 | 113 | 7.86 | 40 pounds/dry ton kaolin |

An analogous sample was produced with an untreated BARRISURF HX kaolin. The kaolin compositions where then used in a 8 gsm coating including 200 parts per hundred binder, 4% ammonium zirconium carbonate (AZC) based on dry latex amount, and caustic for pH control that was applied to an uncoated freesheet base paper and then tested for their Cobb values. The respective Cobb values are shown in FIG. 1. From these results, it can be seen that styrene-based polymer treatment of the kaolin improves the water barrier property of the coated paper.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mineral composition for use in a water barrier coating, the composition comprising:

a mineral coated with 1.25% to 5.0% by weight of a styrene-based polymer, with respect to the total weight of the mineral; and an aqueous solution comprising a binder, wherein the aqueous solution is devoid of sodium, and wherein the mineral composition has a solids content ranging from 40% to 60% by weight.

2. The mineral composition of claim 1, wherein a substrate comprising the composition as a coating has a Cobb value ranging from 1 $g/m^2$ to 25 $g/m^2$.

3. The mineral composition of claim 2, wherein the substrate comprises paper, paperboard, or corrugated linerboard, and wherein the coating is printable.

4. The mineral composition of claim 1, wherein the mineral has a shape factor of at least 20.

5. The mineral composition of claim 1, wherein the aqueous solution further comprises a pH adjuster chosen from potassium hydroxide, ammonium hydroxide, a carbonate, or a combination thereof.

6. The mineral composition of claim 5, wherein the pH adjuster comprises ammonium hydroxide.

7. The mineral composition of claim 1, wherein the mineral comprises kaolin, the binder comprises latex, and the styrene-based polymer is styrene maleic anhydride.

8. The mineral composition of claim 7, wherein the kaolin is coated with 1.5% to 2.5% by weight styrene maleic anhydride, with respect to the total weight of the kaolin.

9. The mineral composition of claim 1, the mineral is selected from the group consisting of kaolin, talc, gypsum, diatomaceous earth, calcium carbonate, attapulgite, bentonite, montmorillonite, natural clays, and synthetic clays.

10. The mineral composition of claim 1, further comprising a dispersant selected from the group consisting of phosphate, silicate, and acrylate, wherein the dispersant is devoid of sodium.

11. The mineral composition of claim 1, wherein the mineral comprises kaolin and talc.

12. The mineral composition of claim 1, wherein the mineral has a steepness of at least 50, a $d_{50}$ diameter ranging from 0.2 μm to 1.5 μm, and a $d_{90}$ diameter ranging from 1 μm to 10 μm.

13. The mineral composition of claim 1, wherein the mineral composition has a Brookfield viscosity ranging from 200 cP to 500 cP when measured at 20 rpm and at less than or equal to 65% solids by weight.

14. A mineral composition comprising:

kaolin coated with styrene maleic anhydride; and an aqueous solution devoid of sodium, the aqueous solution comprising:

at least 20% water by weight, with respect to the total weight of the composition;

3% to 50% binder by weight, with respect to the total weight of the composition; and a dispersing agent.

15. The mineral composition of claim 14, wherein the kaolin has a shape factor of at least 45, a $d_{50}$ diameter ranging from 0.2 μm to 1.5 μm, and a $d_{90}$ diameter ranging from 1 μm to 10 μm.

16. The mineral composition of claim 14, wherein the kaolin is coated with 1.5% to 2.5% by weight styrene maleic anhydride, with respect to the total weight of the kaolin.

17. The mineral composition of claim 14, wherein the aqueous solution further comprises ammonium hydroxide, and the aqueous solution has a pH ranging from 6.5 to 8.5.

18. The mineral composition of claim 14, wherein the kaolin has a steepness of at least 40.

19. The mineral composition of claim 14, wherein a substrate comprising the composition as a coating has a Cobb value ranging from 1 g/m$^2$ to 10 g/m$^2$.

20. A mineral composition comprising:

kaolin coated with 1.5% to 2.5% by weight styrene maleic anhydride, with respect to the total weight of the kaolin, the kaolin having a shape factor of at least 70, a steepness of at least 50, a $d_{50}$ diameter ranging from 0.2 μm to 1.5 μm, and a $d_{90}$ diameter ranging from 1 μm to 10 μm; and an aqueous solution devoid of sodium, the aqueous solution comprising:

at least 20% water by weight, with respect to the total weight of the composition;

3% to 50% binder by weight, with respect to the total weight of the composition;

a dispersing agent; and ammonium hydroxide;

wherein the mineral composition has a solids content ranging from 20% to 70% by weight and a pH ranging from 6.5 to 8.5.

21. The mineral composition of claim 20, wherein about 70% by weight of the solids is kaolin coated with styrene maleic anhydride.

22. The mineral composition of claim 20, wherein the aqueous solution comprises from 0.1% to 0.5% dispersing agent by weight and from 0.025% to 0.25% ammonium hydroxide by weight, with respect to the total weight of the composition.

23. The mineral'composition of claim 20, wherein the binder comprises acrylic latex or vinyl acetate latex.

24. The mineral composition of claim 20, wherein a paper, paperboard, or corrugated linerboard substrate comprising the composition as a coating has a Cobb value ranging from 1 g/m$^2$ to 25 g/m$^2$.

25. The mineral composition of claim 24, wherein the coating is a water barrier coating having a thickness of 8 g/m$^2$.

* * * * *